United States Patent [19]

Schmulian et al.

[11] Patent Number: 4,889,253

[45] Date of Patent: Dec. 26, 1989

[54] DIVIDER FOR LUGGAGE AND THE LIKE

[76] Inventors: Marius Schmulian, Drokford House, Charles Rd., St. Leonards, Sussex; David A. Lake, 11 Churchwood Way, St. Leonards, East Sussex, both of United Kingdom

[21] Appl. No.: 156,623

[22] Filed: Feb. 17, 1988

[30] Foreign Application Priority Data

| | | | |
|---|---|---|---|
| Feb. 20, 1987 | [GB] | United Kingdom | 8704042 |
| Feb. 24, 1987 | [GB] | United Kingdom | 8704331 |
| Apr. 9, 1987 | [GB] | United Kingdom | 8708509 |

[51] Int. Cl.[4] ..... B65D 1/24

[52] U.S. Cl. ..... 220/22.1; 220/22.2; 220/22.3; 220/22.5; 403/107

[58] Field of Search ..... 220/22.1, 22.2, 22.3, 220/22.4, 22.5, DIG. 2; 403/DIG. 10, 245, 107, 108, 388, 393; 248/222.4

[56] References Cited

U.S. PATENT DOCUMENTS

| | | | |
|---|---|---|---|
| 1,674,352 | 6/1928 | Adams | 220/22.3 X |
| 1,714,266 | 5/1929 | Johnson | 220/22.2 |
| 1,995,335 | 3/1935 | Wilke | 220/22.5 |
| 2,082,667 | 6/1937 | Vanderveld | 220/22.2 X |
| 2,161,624 | 6/1939 | Hoerr | 220/22.2 |
| 2,214,042 | 9/1940 | Burdick | 220/22.3 |
| 2,434,251 | 1/1948 | Warnke | 403/393 |
| 2,663,449 | 12/1953 | Smart | 220/22.1 |
| 3,425,756 | 2/1969 | Hubbard | 403/107 |
| 3,649,107 | 3/1972 | Hoffmaster et al. | 403/107 |
| 3,954,202 | 5/1976 | Petrick | 220/22.1 |
| 4,047,353 | 9/1977 | Aarons | 403/107 |

FOREIGN PATENT DOCUMENTS

| | | | |
|---|---|---|---|
| 145911 | 7/1920 | United Kingdom | 220/22.1 |
| 490071 | 8/1938 | United Kingdom | 220/22.1 |

*Primary Examiner*—Stephen Marcus
*Assistant Examiner*—Christine A. Peterson
*Attorney, Agent, or Firm*—Shlesinger & Myers

[57] ABSTRACT

A divider for dividing a space, such as the interior of suitcases, drawers and the like, into individual smaller compartments of various dimensions. The divider includes a main divider of a fixed length, which divides the space into halves. A front and a rear sub-divider co-operate with the main divider for further dividing the halves into smaller compartments. Extension members co-operate with the main divider and the front sub-divider to alter their fixed lengths.

2 Claims, 3 Drawing Sheets

DIVIDER FOR LUGGAGE AND THE LIKE

BACKGROUND AND FIELD OF THE INVENTION

The present invention relates to a divider for dividing a large space, such as the interior of suitcases, drawers and the like, into individual smaller compartments of desired dimensions.

Conventional luggage suffer from the disadvantage that the interior space available for packing clothes and other articles is generally restrained so that the items packed therein tend to merge and dislocated during transport, thereby making it difficult readily to find items when needed. Similarly, the drawers in various types of furniture, such as office desks and home dressers, generally do not include any means for dividing the interior space and thus, during use, the items stored therein have a tendency to get cluttered.

Various means have been devised to divide an enclosed space into a number of individual compartments of smaller size by placing one or more partitions within the enclosed space of a drawer or a suitcase. Examples of such types of devices are shown in U.S. Pat. Nos. 1,630,140 (Sibbald), 1,875,695 (Beard), 2,695,112 (Bonnevay), 2,859,724 (Wuorio), 3,410,455 (Pilley), 3,491,909 (Ikelheimer), 3,746,181 (Benoit), 3,837,560 (Kuchuris), 4,061,224 (Fuhri) and 4,065,021 (Kedzlers).

These devices, however, are disadvantageous in that the size of the compartments can not be changed once the device is installed in an enclosed space, or the devices are integrally formed with the given space such that once the device is in place, it is difficult to remove and use in another enclosed space. In other words, once the device has been used in connection with one type of space, it can not be reused. Therefore, the inflexibility of such types of devices can be disadvantageous in that the predetermined dimensions of the individual compartments may not be acceptable to another user.

OBJECTS AND SUMMARY OF THE INVENTION

Accordingly, it is one object of the invention to provide a divider for dividing a space into smaller compartments of various dimensions.

Another object of the present invention is to provide a divider which can be used to divide one space of one dimension, and be reused to divide another space of a different dimension.

A further object of the invention is to provide a divider which can be used to divide spaces of different dimensions.

A still further object of the present invention is to provide a divider which can be used to vary the size of the compartments to various desired dimensions.

Another object of the present invention is to provide a divider for dividing a space which is of light-weight and easy to use.

A further object of the invention is to provide a divider for dividing the interior space of a suitcase and the like into smaller compartments.

A still further object of the present invention is to provide a divider for dividing the interior of a drawer and the like into smaller compartments.

Another object of the present invention is to provide a divider for dividing a space that is easy to assemble and disassemble.

In summary, the present invention provides a divider for dividing the interior space of the suitcases, drawers and the like, into smaller individual compartments of desired dimensions.

These and other objects and other advantages of the invention will be readily apparent in view of the following description and drawings of the above-described invention.

DESCRIPTION OF THE DRAWINGS

The above and other objects and advantages and other features will become apparent from the following detailed description of the preferred embodiment of the invention illustrated in the accompanying drawings, in which.

DETAILED DESCRIPTION OF THE INVENTION

Figure 1:
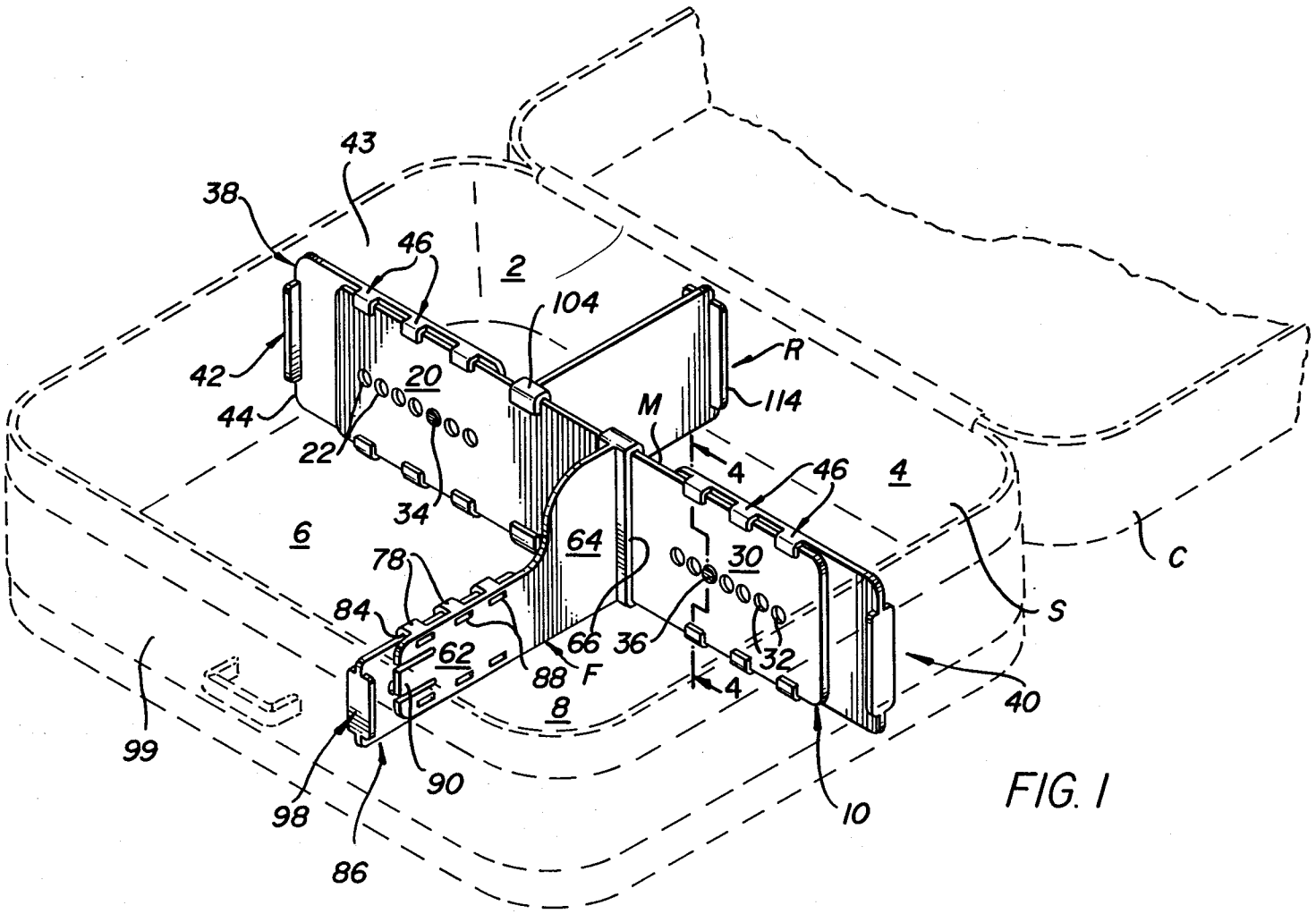
FIG. 1 is a perspective view of the divider of the present invention.
Figure 2:
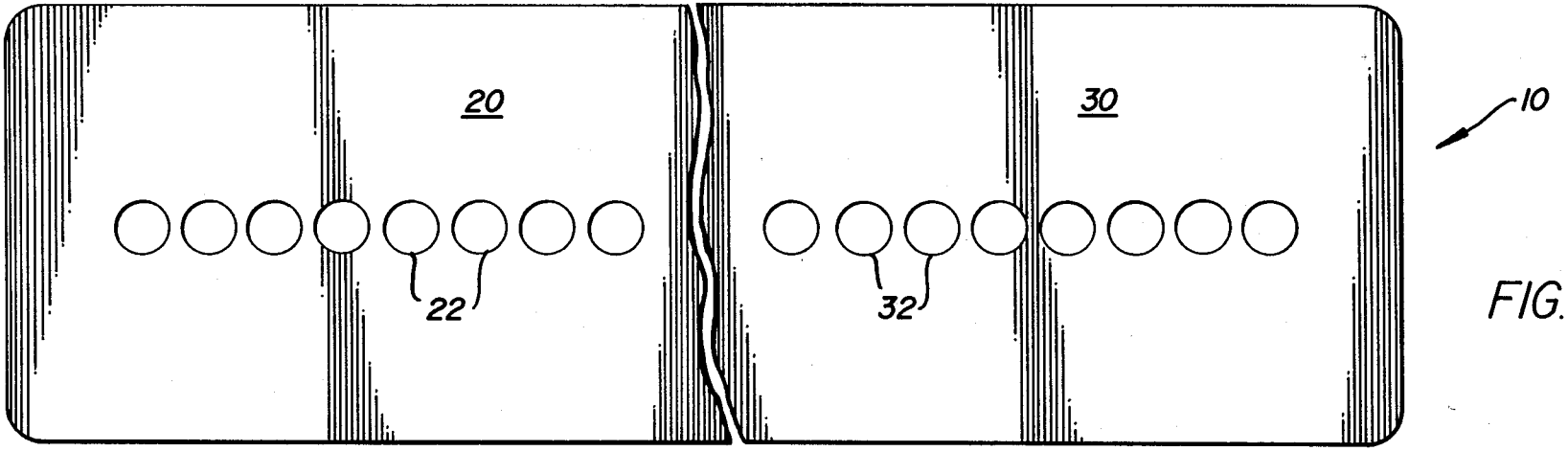
FIGS. 2–3 and 5–7 show various components of the divider of the present invention.

As shown in FIG. 1, the divider D of the present invention includes a main divider M. A front sub-divider F, and a rear sub-divider R, are respectively attached to the front and rear of the main divider. Main divider M divides the interior space S of a container C, such as a suitcase or the like, into halves and the front and rear sub-dividers F and R, respectively, divide the halves into smaller compartments 2, 4, 6 and 8 of smaller dimensions.

The main divider M includes a main plate member 10 of a fixed length, which as shown in FIG. 1, is rectangular in shape and has two sections 20 and 30. Each section 20 and 30 of main plate member 10 includes a number of serially arranged holes 22 and 32, respectively, to receive projections 34 and 36 of sliding extension members 38 and 40 (described below):

Sliding extension members 38 and 40 are adjustably mounted on main plate member 10 on its sections 20 and 30, respectively. The sliding extension members 38 and 40 are mounted such that they can be used to alter the fixed length of main plate number 10.

Figure 3:
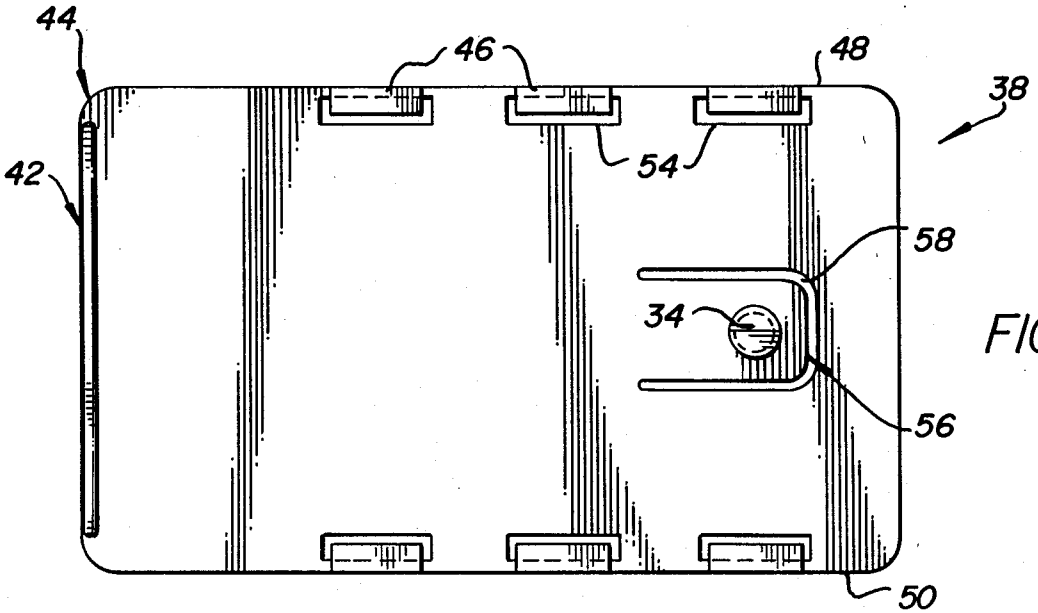

As shown in FIG. 3, sliding extension member 38 (sliding extension member 40 being similar to sliding extension member 38), includes a support member 42 located on an edge portion 44 thereof for supporting the divider D against a corresponding wall 43 of the suitcase C.

The term "suitcase or the like" as used herein should be interpreted to include any enclosed container or similar structure which is intended to confine or carry a variety of personal articles of differing sizes and shapes.

Figure 4:
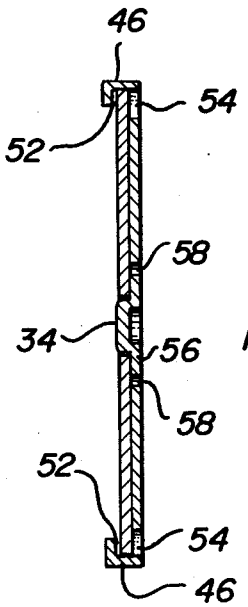
FIG. 4 is a cross-sectional view of the divider taken along line 4—4 of FIG. 1.

As best shown in FIGS. 3 and 4, sliding extension member 38 includes a number of generally "L-shaped" mounting members 46, which extend from top and bottom edges 48 and 50 thereof and define groove 52 therebetween. The width of groove 52 corresponds to the width of the main plate member 10 such that, when sliding extension member 38 is mounted on main plate member 10, section 20 slides in the grooves 52 thereby securely mounting the extension member 38 thereon. Windows 54 are provided on sliding extension members 38 and 40 for each mounting number 46. Although, only three mounting members have been shown, it will be apparent to those skilled in the art that depending upon the circumstances this number may be increased or decreased to accomodate various extension members of differenct dimensions.

In order to lock the sliding extension members 38 and 40 on main plate member 10, a "tongue-and-groove" type of arrangement is provided, which secures sliding extension members 38 and 40 on main plate number 10. As shown in FIG. 3, the locking arrangement includes projections 34 and 36 on sliding extension members 38 and 40 which are received in one of the holes 22 in section 20 and one of the holes 32 in section 30 of main plate number 10.

As shown in FIG. 3, sliding extension member 38 includes a "tongue-shaped" member 56, which defines a slot 58 thereabout such that the tongue member 56 is free to be deflected laterally when a pressure is applied on one side thereof. The projection 34 is provided on one side of the tongue member 56. Accordingly, when sliding extension member 38 is mounted on main plate 10, the projection 34 is snapped into one of the holes 22. It would be clear to those skilled in the art, that when it is desired to vary the fixed length of main plate 10, the projections 34 and 36 can be snapped out of their corresponding hole by applying a pressure by a finger or the like and the sliding extension member 38 and 40 be moved such that projections 34 and 36 are received into another hole 22 and 32. Although the sliding extension members 38 and 40 are mounted and locked on main plate member 10, by using a "tongue-and-groove" arrangement, other alternative means may be used to obtain adjustable locking of the sliding members as contemplated by the present invention.

Figure 5:
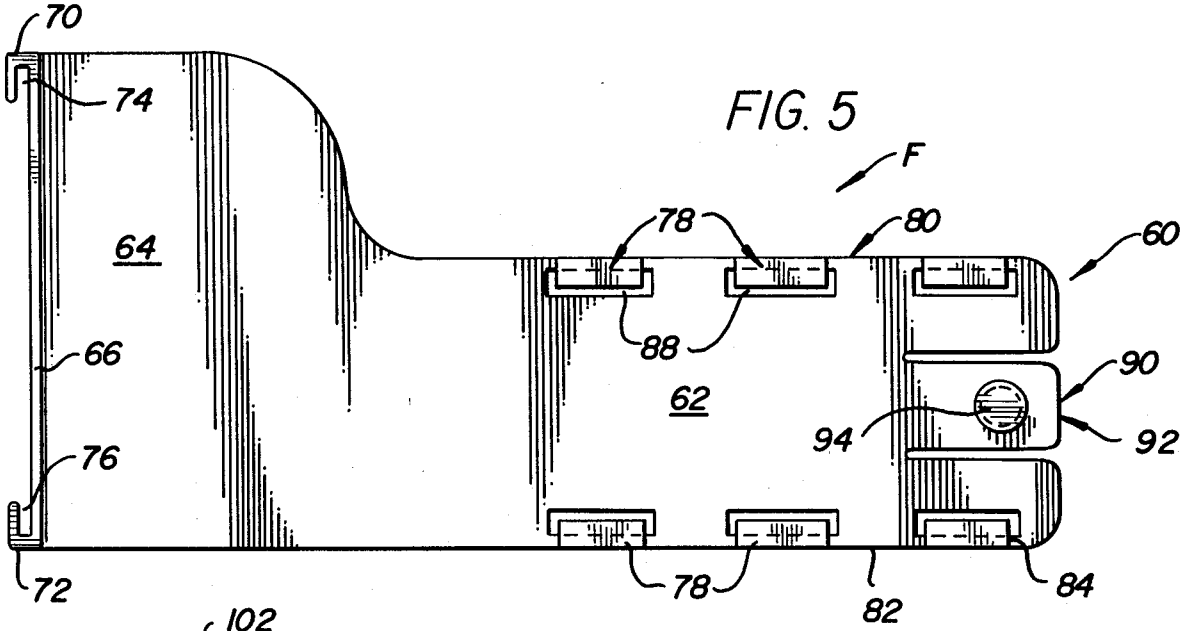

As shown in FIG. 5, front sub- divider F, includes a front plate member 60 which includes a front section 62 and a rear section 64. A support member 66 is affixed to the rear edge 68 of the rear section 64 which includes generally "L-shaped" mounting jaws 70 and 72 defing spaces 74 and 76 therein. The width of spaces 74 and 76 corresponds to the thickness of main plate 10, such that when main plate number 10 is slid into spaces 74 and 76, it is securely held therein.

The front plate member 60 also includes a number of "L-shaped" mounting members 78 affixed on top and bottom edges 80 and 82 thereof. The mounting members 78 define a groove 84 such that a front extension member 86 (FIG. 6) could be securely mounted thereon. As in sliding extension members 38 and 40, windows 88 are also provided on front plate member 60. In order to securely lock the front extension member 86 on front plate member 60, a "tongue-and-groove" locking arrangement is used which is similar to the "tongue-and-groove" arrangement described above.

Figure 6:
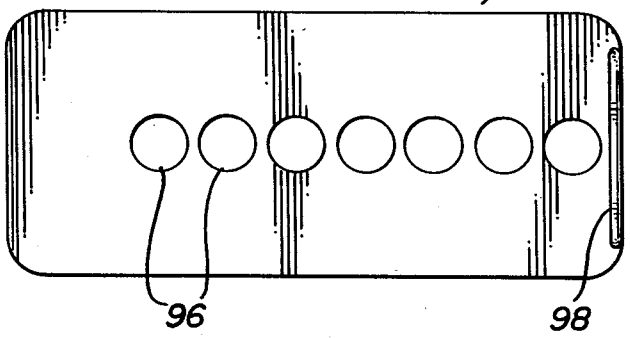

The front plate member 60 includes a tongue member 90, the tip 92 of which forms an edge portion of the front plate member 60. A projection 94 is mounted on one side of the tongue member 90, such that by deflecting the tongue member 90 the projection member 94 can be dislodged from one of the holes 96 in front extension member 86 and lodged into another hole, as shown in FIG. 6. The front extension member 86, as shown in FIG. 1, is mounted on front plate member 60 to alter the fixed length of the front plate member 60.

As shown in FIG. 6, the front extension member 86 also includes a support member 98 which is located on one edge thereof to support the divider D against a front wall 99 of the suitcase C.

Figure 7:
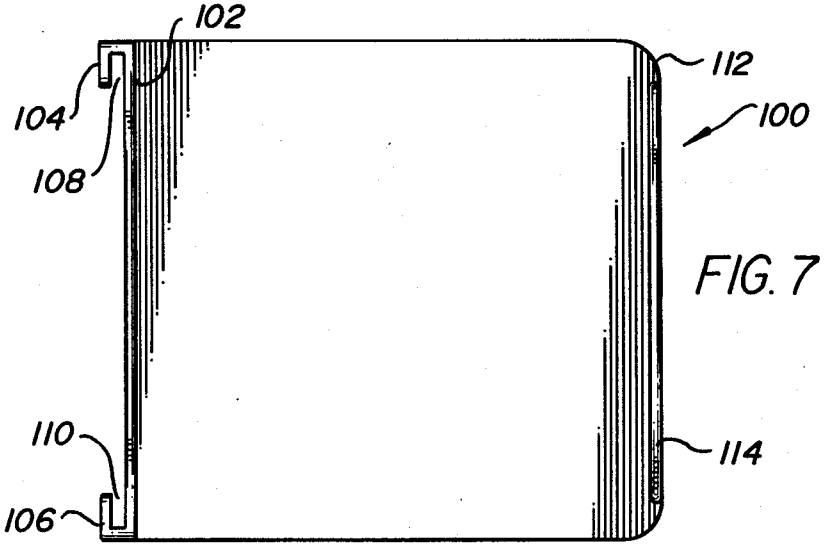

As shown in FIG. 7, the rear-divider R, includes a rear plate member 100 which is slidably mounted on the main plate member 10. The rear plate member 100 also includes means for slidably mounting the rear plate member 100 onto main plate member 10 similar to the mounting means of front divider F. More specifically, on one rear edge 102 of rear plate member, generally "L-shaped" mounting jaws are provided to define grooves 108 and 110. The width of the groove corresponds to the thickness of the main plate member 10 such that main plate member easily slides into the grooves 108 and 110. On front edge 112, which is opposite to the edge on which the mounting jaws are provided, a support member 114 is provided to secure the divider D against the rear wall 115 of the suitcase C. Although an extension member is not provided on rear sub-divider, it is within in the scope of the invention to provide an extension member similar to the front extension member 86 in order to alter the fixed length of the rear sub-divider.

The main divider M, the front sub-divider F and the rear sub-divider R and the sliding extension members 38, 40 and 86, all can be made from a suitable material which is light-weight and easy to manufacture, such as plastic, cardboard or aluminum. However, it is preferred that the divider of the present invention be made of a plastic material which is light-weight and relatively inexpensive. In addition, various colors may be used to designate various parts of the divider D in order to match with the color of the article in which the divider is going to be used. For example, wood-colored plastic may be used to produce the divider of the present invention for use in a drawer of an office desk or a home dresser.

OPERATION AND USE

In operation, the relative positions of the front and rear dividers F and R on the main divider M can be changed to produce a wide number of compartments with different dimensions. Similarly, by adjusting the relative positions of sliding extension members 38, 40 and 86, the compartments 2,4,6 and 8 of larger or smaller dimensions can be produced.

As shown in FIG. 1, the divider of the present invention is placed in a suitcase C or the like and the sliding extension members 38 and 40 are slid on the main plate member 10 until the abut the corresponding walls 43 and 45 of the suitcase C. Similarly, the front extension member 86 is also slid on the front plate member 60 until it abuts the front wall 99 of the suitcase. The relative positions are the front and rear dividers F and R can be adjusted to obtain different side compartments in the front and the rear of the suitcase.

As it is clear from the foregoing description, by adjusting the relative positions of the front and rear sub-dividers F and R and the extension members 38, 40 and 86, the same divider D can be used to divide the interior space of suitcases having different dimensions.

While this invention has been described as having a preferred design, it is understood that it is capable of further modifications, alterations, uses and/or adaptations of the inventions and following in general the principles of the present invention and including such departures from the present disclosure has come within known or customary practice in the art to which the invention pertains to, and as may be applied to the central features here in before set forth and fall within the scope of the invention of the appended claims.

What is claimed is:

1. A divider for luggage, comprising:

(a) a central support member;

(b) two extension members which slide at the ends of said support member and substantially coplanar therewith;

(c) said extension members having a combined length substantially less than the length of said support member and secured to said support member and removable from the ends thereof by hook means at top and bottom to prevent vertical disengagement from said support member;

(d) said extension members each including a stop at one end thereof engageable with an end of said support member and each having an inside end spaced a substantial distance from its respective stop;

(e) said inside ends of said extension members defining an unobstructed space on said support member when mounted thereon and having said stops engaging with the corresponding ends thereof;

(f) a pair of transversely extending normally unremovable subdividers slidably mounted in said unobstructed space and only movable therein relative to each other and between said inside ends of said extension members so that each sub-divider at all times provides a barrier with said support member when positioned in the luggage and dividing the luggage with four compartments of substantial area;

(g) said sub-dividers each including means engaging the top and bottom of said support member to prevent vertical disengagement therefrom;

(h) said sub-dividers being disengageable only when at least one of said extension members is removed from said support member;

(i) said support member including a plurality of holes disposed adjacent each end thereof; and (j) said extension members each including a projection selectively received in one of said holes to thereby secure said extension members on said support member at a selected position.

2. The divider of claim 1, wherein:

(a) one of said pair of sub-dividers including a step;

(b) a slidable member movably mounted on said one of said pair of sub-dividers and substantially coplanar therewith; and (c) said slidable member having a length substantially less than the length of said one of said pair of sub-dividers.

* * * * *